United States Patent [19]

Candelas

[11] Patent Number: 4,796,960

[45] Date of Patent: Jan. 10, 1989

[54] CAROUSEL PORTABLE PANTRY

[76] Inventor: Rodrigo A. Candelas, P.O. Box 63133, 3725 E. Ramboz Dr., Los Angeles, Calif. 90063

[21] Appl. No.: 98,219

[22] Filed: Sep. 18, 1987

Related U.S. Application Data

[63] Continuation-in-part of Ser. No. 933,639, Nov. 19, 1986, abandoned.

[51] Int. Cl.[4] ..... A47B 88/00

[52] U.S. Cl. ..... 312/305; 312/299; 312/291; 312/249

[58] Field of Search ..... 312/202, 252, 291, 305, 312/326, 250, 291, 249; 248/131

[56] References Cited

U.S. PATENT DOCUMENTS 841,180 1/1907 Rauwald ..... 312/305

1,082,705 12/1913 Robinson ..... 312/291

1,213,026 1/1917 Saned ..... 312/202

3,302,594 2/1967 Barnett et al. ..... 248/131

4,232,988 11/1980 Kochanneck ..... 312/202

FOREIGN PATENT DOCUMENTS 0769083 2/1957 United Kingdom ..... 312/305

*Primary Examiner*—Kenneth J. Dorner

*Assistant Examiner*—Gerald A. Anderson

*Attorney, Agent, or Firm*—Harlan P. Huebner

[57] ABSTRACT

A carousel portable pantry including a cabinet with a pair of outer and inner storage cylinders having shelves each concentrically mounted within said cabinet and each independently rotatable one from the other, and a vertical opening in both said cabinet and outer storage cylinder for access to the shelves of said outer and inner storage cylinders.

4 Claims, 2 Drawing Sheets

CAROUSEL PORTABLE PANTRY

CROSS-REFERENCE

This is a continuation-in-part of pending application Ser. No. 933,639, filed Nov. 19, 1986, now abandoned.

BACKGROUND OF THE INVENTION

1. Field of the Invention

This invention relates to a carousel portable pantry particularly adopted to receive foods stuffs for storage.

2. Description of the Prior Art

In the storage of can goods and food stuffs in kitchens conventional cabinets have draw backs as to fully utilizing the space available.

Also in conventional cabinets it is usually difficult to reach goods that are in the back of the shelf or cabinet. Generally it requires that all of the goods in front be removed to reach those in back. Such action is time consuming because not only must the front goods be removed but they must be replaced after the wanted goods are obtained.

SUMMARY OF THE INVENTION

It is an object of the present invention to provide a storage cabinet in the form of a portable carousel type of cabinet.

Another object of the present invention is to provide a carousel portable pantry wherein the cabinet may be of any type of compatible exterior shape in horizontal cross section such as round or square wherein there is provided on one side an opening for access.

A further object of the present invention is to provide a pantry with a rotatable cylinder with shelving therein to receive goods and upon rotation, goods are presented at the opening for removal.

A still further object is to provide a pantry with a door closure and wherein shelving, drop in or other receptacles may be provided on the inside of the door to receive goods for storage.

Another object of the present invention is to provide a pantry wherein there are two rotatable carousels concentrically arranged within a cabinet or housing and the carousels are each adapted to receive goods for storage.

A further object of the preset invention is to provide a pantry wherein the concentric carousels are independently rotatable one from the other.

Another object of the present invention is to provide a pantry that has multiple storage area without wasting space.

These and other objects and advantages will become apparent from the following part of the specification wherein details have been described for the competence of disclosure, without intending to limit the scope of the invention which is setforth in the appended claims.

BRIEF DESCRIPTION OF THE DRAWINGS

These advantages may be more clearly understood from the following detailed description and by reference to the drawings in which.

DETAILED DESCRIPTION OF THE PREFERRED EMBODIMENT

Figure 1:
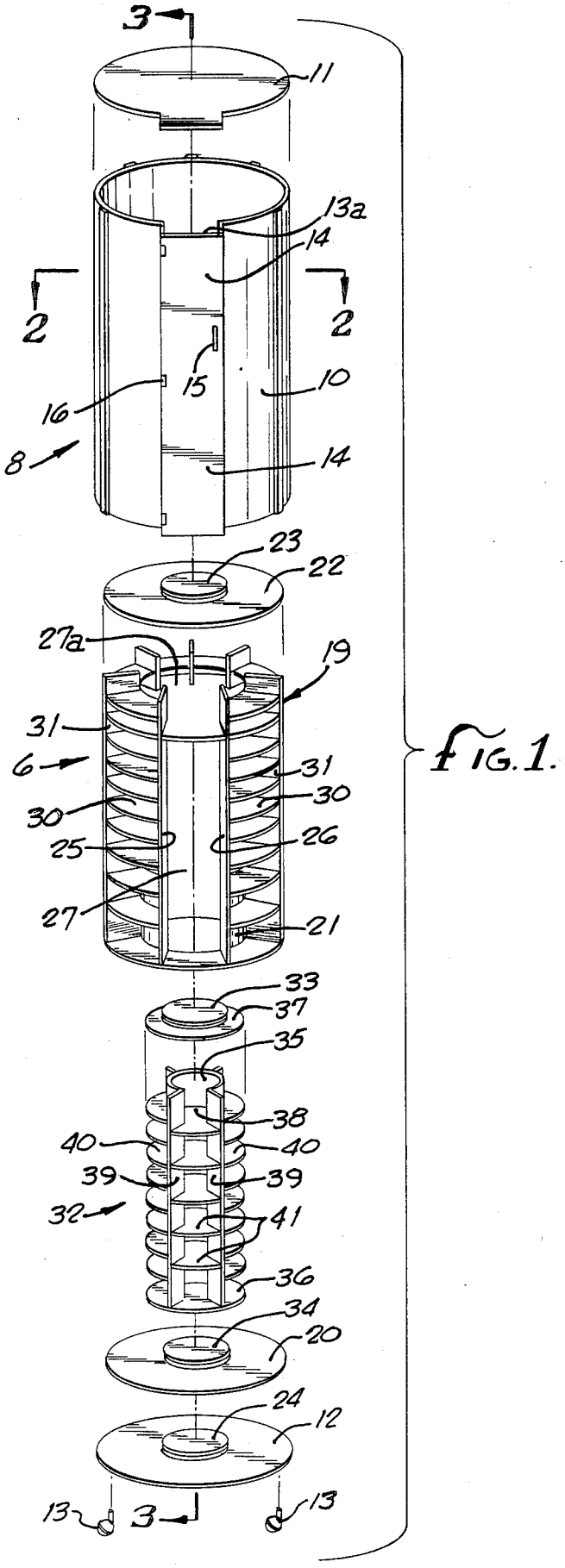
FIG. 1 is an exploded view of the present invention of a carousel portable pantry.

Referring now to the drawings, there is illustrated in FIG. 1 an exploded view of a carousel portable pantry generally designated 6.

There is an exterior housing 8 which preferably includes a cylindrical tubular side wall 10. The side wall 10 is closed at the top by a circular top surface plate 11. The bottom of the wall 10 is closed by a circular bottom surface plate 12.

Figure 3:
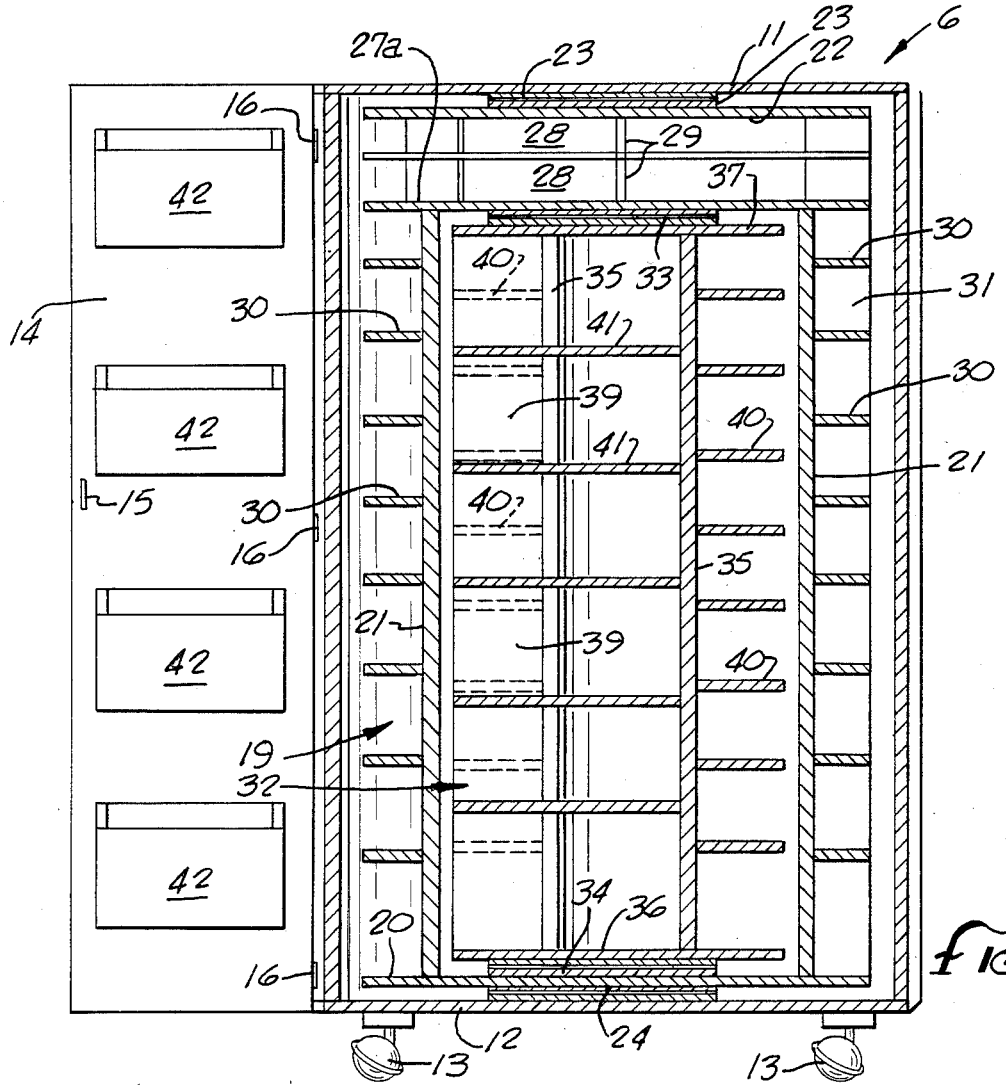
FIG. 3 is vertical cross-sectional view of the pantry of this invention taken on line 3—3 of FIG. 1.

As can best be seen in FIG. 3 the bottom surface plate 12 is fitted with conventional casters 13 so that the pantry 6 may be moved from place to place as desired.

The wall 10 is cut out longitudinally forming an opening 13*a*. The opening 13*a* is fitted with a door 14 having a lock 15 and there are hinges 16 so the door may rotate from a closed to open position such as shown in dotted lines in FIG. 2. The opening 13*a* will allow access to the interior.

Fixedly mounted on the bottom surface place 12 is a conventional type of turntable 24 having a rotatable portion above the fixed portion.

Mounted on top of the turntable 24 within housing 8 is an outer storage cylinder generally designated 19. The cylinder 19 includes a cylindrical bottom plate 20, a cylindrical wall 21 and a cylindrical top plate 22 under and spaced from top plate 11. The plates 20 and 22 extend beyond the cylinder wall 21. Plate 20 actually forms an outwardly radiating shelf for storage.

Mounted on the top plate 22 is another upper conventional turntable 23 and it is also secured to the bottom of top plate 11. In this way the outer cylinder 19 may rotate about a longitudinal axis within the housing 8.

The cylinder 19 is also mounted on a bottom turntable 24 which is mounted on the bottom wall 12. Thus, cylinder 19 is positioned between two turntables for rotation.

Figure 2:
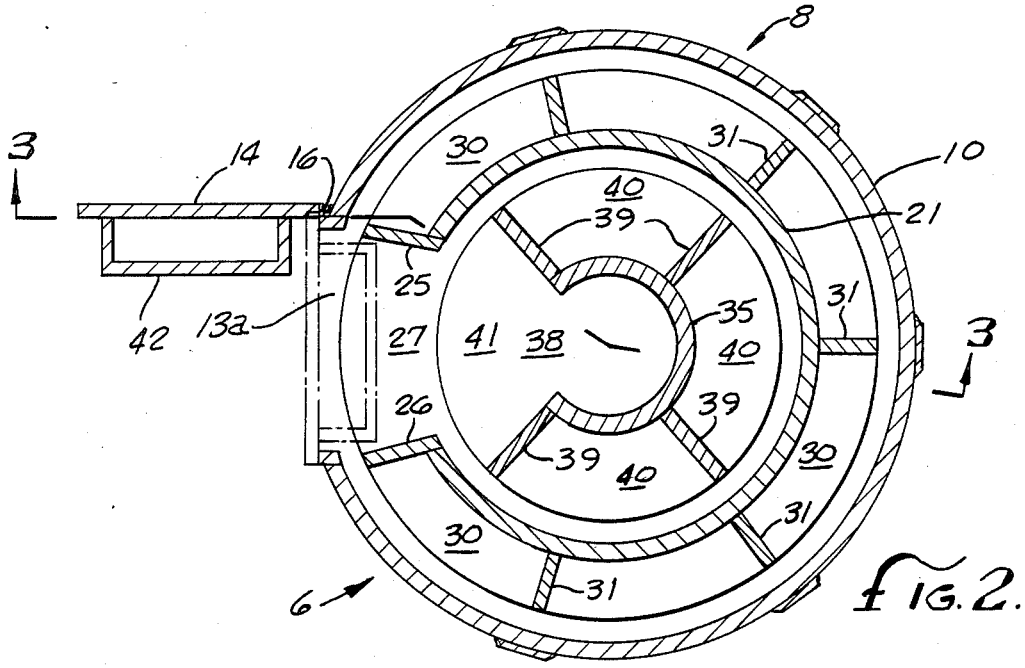
FIG. 2 is a horizontal cross-sectional view of the pantry of this invention taken on line 2—2 of FIG. 1.

In FIG. 2 it can be seen that the outer storage cylinder 19 is not a full cylinder it is formed with vertical end plates 25 and 26 creating an opening 27 along the vertical height of the pantry 6. In other words the cylinder 19 is interrupted forming the opening 27.

In addition, it should be noted that there is an inner circular plate 27*a* which spaced below the top plate 22 of cylinder 19 (see FIG. 3). Because the space between the respective horizontal plates 22 and 27*a* is somewhat restricted the inventor provides for reduced area shelving which is referred to as spice shelves 28. The shelves 28 also may have vertical spacers 29 to compartmentize the areas.

Also, with regard to the cylinder 19 there are shelves 30 that extend outwardly radially around the cylinder which can receive goods for storage. There also may be vertical spacers 31 between the shelves 30 to compartmentize the storage area.

As can be seen from FIG. 2 the space between end walls 25 and 26 is complimentary with the opening 13*a* in the housing so that access may be had to the interior of the cylinder or wheel 19.

Within the cylinder 19 there is mounted an inner concentric storage cylinder 32. In order to assure rotation of the cylinder 32 conventional upper and lower turntables 33 and 34 are provided. The upper turntable 33 is affixed to the plate 27*a* and the lower turntable 34 is affixed to the plate 20 of cylinder 19.

The storage cylinder 32 includes an inner cylinder core wall 35 which extends vertically between inner cylinder bottom plate 36 and inner cylinder top plate 37. The core wall 35 peferrably has a vertical opening 38 for access into the interior of the cylinder core 35.

Extending radially outward of the core wall 35 and extending the vertical length thereof are vertical spacers 39 that serve the same purpose as the spacers 29 and 31.

In addition, the core wall 35 is divided into two types of store shelving. The first shelving are shelves 40 that extend around the outside of the perimeter of the core wall 35 from one vertical spacer 39 to the other side spacer 39, that is those that form the opening 38 therebetween.

A second set of shelves 41 extend from outwardly of the opening 38 to the interior of core wall 35. These shelves 41 are preferably spaced at greater vertical distances from each other to accommodate large battles and jars.

As can be seen from FIG. 3 the door 14 may be fitted on the inside with a number of drop in compartments 42.

In operation the door 14 of the pantry 6 is opened and if it is desired to obtain something or store it on the outer storage cylinder 19 it may be rotated until the proper product or space is located, the product is removed or stored on the shelf 30 by being passed through the opening 13a.

The rotation of the outer storage cylinder 19 does not necessarily require that the inner storage cylinder core 35 be moved with the cylinder 19.

In order to gain access to the inner storage cylinder core 35, the outer storage cylinder 19 is rotated so that the opening 27 created therein as previously described is lined up with opening 13*a*. At this point the core 35 may be hand rotated for access to the outer generally small shelf space or to the opening 38 for access to large products. In such case all of the openings are aligned.

It is preferred that the pantry 6 be made of wood that can be painted or stained to meet the color requirements for a kitchen or service porch. However, it should be noted that without departing from the spirit of the invention metal or plastic may be used with equally effective results.

In addition, the demensions of the pantry 6 are not truly critical as various sizes can be produced to accommodate the size of the area where the pantry will be issued.

The invention and its attendant advantages will be understood from the foregoing description and it will be apparent that various changes may be made in the form, construction and arrangements of the parts without departing from the spirit and scope thereof or sacrificing its material advantages, the arrangements herein before described being merely by way of example. I do not wish to be restricted to the specific forms shown or uses mentioned, except as defined in the accompanying claims, wherein various portions have been separated for clarity of reading and not for emphasis.

I claim:

1. A carousel portable pantry for the storage of products including:

a cabinet including a vertical wall, and top and bottom end plates closing said wall and a vertical opening in said wall for access to the interior of said cabinet;

an outer storage cylinder rotatably mounted within said cabinet including a vertical opening therein, said outer storage cylinder including a plurality of vertically spaced shelves radiating outwardly from said cylinder toward said cabinet, and said outer storage cylinder rotatable to present said shelves to said vertical opening in said cabinet for access thereto;

an inner storage cylinder rotatably and concentrically mounted within said outer storage cylinder, said inner cylinder including a vertical opening therein, said inner storage cylinder also including a plurality of vertically spaced shelves rotating extending outwardly from said inner cylinder toward said outer storage cylinder, and a plurality of vertically spaced shelves circular in configuration fitted within said inner cylinder and the spacing of said circular shelves not adopted to correspond with the horizontal plane of said outwardly extending shelves of said inner storage cylinder; and said inner storage cylinder rotatable to present said outwardly extending shelves and said circular shelves to said vertical opening in said outer storage cylinder for access;

a plurality of turntables interspaced between the cabinet and cylinders at the bottom and top to effect rotation of said outer and inner storage cylinder; and said inner storage cylinder includes a plurality of vertical dividers breaking up the circumferential area of said vertically spaced outwardly extending shelves of said inner cylinder.

2. A carousel portable pantry as defined in claim 1 wherein said outer storage cylinder includes:

seven vertical dividers placed around said cylinder to divide up the circumferential area of each of said outer cylinder shelves.

3. A carousel portable pantry as defined in claim 1 wherein said outer storage cylinder includes at least two vertically spaced shelves which are vertically spaced one from the other a lesser distance than any of the other shelves whereby conventional spice containers may be received and accommodated.

4. A carousel portable pantry as defined in claim 1 wherein said cabinet includes a door having an interior and exterior surface closing said vertical opening and said door interior is fitted with a plurality of drop in compartments for storage.

* * * * *